United States Patent [19]

Linka

[11] Patent Number: 4,815,504

[45] Date of Patent: Mar. 28, 1989

[54] MULTI-SYSTEM WEAVING LOOM

[75] Inventor: Adolf Linka, Hechingen-Bechtoldsweiler, Fed. Rep. of Germany

[73] Assignee: Lindauer Dornier Gesellschaft m.b.H., Lindau/Bodensee, Fed. Rep. of Germany

[21] Appl. No.: 123,597

[22] Filed: Nov. 20, 1987

[30] Foreign Application Priority Data

Jul. 23, 1987 [DE] Fed. Rep. of Germany ..... 3724358

[51] Int. Cl.[4] ..... D03D 49/22; D03D 47/26

[52] U.S. Cl. ..... 139/436; 139/13 R; 139/115

[58] Field of Search ..... 139/13 R, 16, 436, 450, 139/114, 115

[56] References Cited

U.S. PATENT DOCUMENTS

| | | | |
|---|---|---|---|
| 3,414,020 | 12/1968 | Fend | 139/436 |
| 3,618,640 | 11/1971 | Linka . | |
| 3,626,990 | 12/1971 | Linka . | |
| 3,749,135 | 7/1973 | Linka . | |
| 4,479,517 | 10/1984 | Plammer et al. | 139/436 |

FOREIGN PATENT DOCUMENTS

| | | | |
|---|---|---|---|
| 308663 | 7/1973 | Austria . | |
| 83864 | 5/1955 | Czechoslovakia . | |
| 1072569 | 6/1956 | Fed. Rep. of Germany | 139/439 |
| 1020578 | 12/1957 | Fed. Rep. of Germany . | |
| 1066958 | 10/1959 | Fed. Rep. of Germany . | |
| 1239637 | 4/1967 | Fed. Rep. of Germany . | |
| 1287526 | 1/1969 | Fed. Rep. of Germany . | |
| 2329303 | 1/1974 | Fed. Rep. of Germany . | |
| 3346030 | 6/1985 | Fed. Rep. of Germany . | |
| 2130255 | 5/1984 | United Kingdom . | |

*Primary Examiner*—Henry S. Jaudon

*Attorney, Agent, or Firm*—Frishauf, Holtz, Goodman & Woodward

[57] ABSTRACT

To compensate for difference in path length between a warp thread guide element and a reference position, for example adjacent a take-up beam (3) beyond the shed (8), a plurality of guide elements (34) are located between a run-on guide rod (31) and the shed forming heddles (7), the guide elements being controlled to move in synchronism with the heddles in a direction essentially along a central plane (8*a*) of the shed to compensate for lateral deflection of the threads as the shuttle moves through the shed, and the shed is closed after the shuttle (9) has passed therethrough. The thread guide elements (37) preferably are U-shaped structures, retaining a plurality of transverse rods (39), and deflected by a cam shaft (42, 47) in synchronism with shuttle movement and movement of the heddles.

20 Claims, 4 Drawing Sheets

MULTI-SYSTEM WEAVING LOOM

Reference to related patents, the disclosure of which is hereby incorporated by reference:

U.S. Pat. No. 3,049,155
U.S. Pat. No. 3,618,640
U.S. Pat. No. 3,626,990
U.S. Pat. No. 3,749,135.

Reference to related disclosures, illustrating the state of the art:

German Patent Disclosure Document DE-OS No. 33 46 030
Czechoslovakian Patent No. 83,864
German Patent No. 1,066,958
German Patent No. 1,287,526

Reference to related applications, the disclosure of which is hereby incorporated by reference, and assigned to the assignee of this application:

U.S. Ser. No. 146,263, filed Jan. 20, 1988, LINKA et al
U.S. Ser. No. 123,376, filed Nov. 20, 1988, LINKA
U.S. Ser. No. 131,637, filed Dec. 11, 1987, LINKA et al
U.S. Ser. No. 163,619, filed Mar. 3, 1988, LINKA et al The present invention relates to weaving, and more particularly to a multi-system or multi-unit weaving loom which also has apparatus to equalize warp thread or yarn tension regardless of position of the heddles, as the shed is formed.

BACKGROUND

Various types of weaving looms which operate on a single-system basis are so constructed that a shed is opened, extending over the entire width of the fabric to be made. A movable back rail can be used in order to compensate for variations in warp thread tension as the shed is formed. These variations in tension are caused by the heddles deflecting the ward threads - or a portion thereof—from the plane of the fabric towards one side or the other. Thus, the length of the path of the thread from the back rail to the wind-up fabric roll changes.

It has been proposed—see German Patent Disclosure Document DE-OS No. 33 46 030—to decrease the tension applied to the warp thread by providing a thread deflection element which contacts the warp threads, and which is supported on at least one elastic element, for example a cushion or pillow filled with a compression medium, or on a spring of the back rail, to permit some resilient deflection. The thread deflection element can be formed of a single beam or rod or bar extending over the width of the fabric to be made, and pivotable about an axis parallel to the width of the fabric. Alternatively, it has been proposed to subdivide the beam or rod into a plurality of similar narrower units made of stiff individual strip or rod elements, located essentially without gaps or spaces in a row adjacent each other, each one supported on an elastic element. The elastic element is formed by a straight circular cylindrical pipe or tube, open at the ends, of elastic material, such as soft rubber, made with thick walls, so that its stiffness for elastic support of the individual support or deflection elements is of suitable strength. It is difficult to prevent penetration of the tensioned threads, which are laterally not guided, into the stiff individual strip units. Such a back rail or back rest is suitable, apparently, only for weaving looms in which the shed is opened in advance of each introduction of the shuttle or weft thread over the entire width of the fabric. This is standard in weaving machines of a single-system arrangement, and such tensioning equalization apparatus is only suitable therefor.

Multi-system of multi-feed or unit weaving looms have a plurality of shuttles which are introduced, longitudinally staggered, between a shed which moves along the width of the fabric. The multiple shuttles simultaneously introduce the weft threads. The shed has the form of a progressive wave. If a back rail or rest is used in such a weaving machine which is resiliently supported, while extending over the width of the fabric, as proposed, for example, in German Pat. Nos. 1,066,958 and 1,287,526, effective equalization of the warp threads cannot be obtained thereby. Consequently, a properly and precisely controlled engagement of the weft thread is no longer insured since the corresponding edge of the fabric at the initial point of the weft thread within the closed shed moves and, consequently, the engagement pressure of the weft thread tends to be reduced, that is, the weft thread yields. A predetermined minimum engagement pressure of the weft thread is required at the initial position of the weft thread upon its entry into the shed.

THE INVENTION

It is an object to provide a system to equalize tension of warp threads in multi-unit flat weaving looms which results in effective compensation or equalization for tension in the warp threads upon formation of the shed and, thus, which insures a precise engagement of the weft threads in the fabric.

Briefly, the threads are deflected and guided by a plurality of independently movable deflection elements, each of which guides at least one warp thread or, preferably, a group of warp threads. The deflection elements are movable, under control of a movement control arrangement which is coupled to the deflection elements, to move the deflection elements in a direction to compensate for shift of the path length of the warp threads to the take-up means, for example a take-up roll, between the opening and closing of the shed. The operation of the movement control means is synchronized for movement of the deflection element in synchronism with the shed forming structure, in such a manner that the deflection elements move towards the take-up mechanism when the shed is open, and move away therefrom after the weft thread has been inserted by the shuttle, thereby compensating for variations in tension in the warp threads as the shed is opened and closed.

The system has the advantage that the compensation of tension of the warp threads can proceed, progressively, with the formation of the shed which progresses transversely across the fabric, so that the initial position of the weft thread will occur under precisely defined and maintained tension conditions of the warp threads. This insures precise positioning of the weft threads transversely to the warp threads in the finished goods. The warp threads are guided over the deflection elements such that, upon progressive formation of the shed, the warp threads cannot become released from the deflection elements, or can be pinched therein. The individual deflection elements, which are moved by the control arrangement in positively controlled synchronism with the travel of the shed, thus permit compensation for changes in the length of the operating path of the respective warp threads from the back rail to the take-up arrangement.

In accordance with a preferred feature of the invention, the deflection elements are retained on elastic springs, for example leaf springs, which result in a particularly simple and space-saving arrangement. The leaf springs preferably extend in form of a spring comb or extending spring tongues essentially parallel to the direction of the warp threads before they are deflected. They are coupled at one end to a holding rail or the like, and, along the length thereof towards free end portions support the deflection elements. The spring elements can easily be deflected, against spring force, by engaging with eccentrics on a cam shaft which rotates in synchronism with the elements which control movement of the heddles, and thus forming the shed.

DRAWINGS

DETAILED DESCRIPTION

Figure 1:
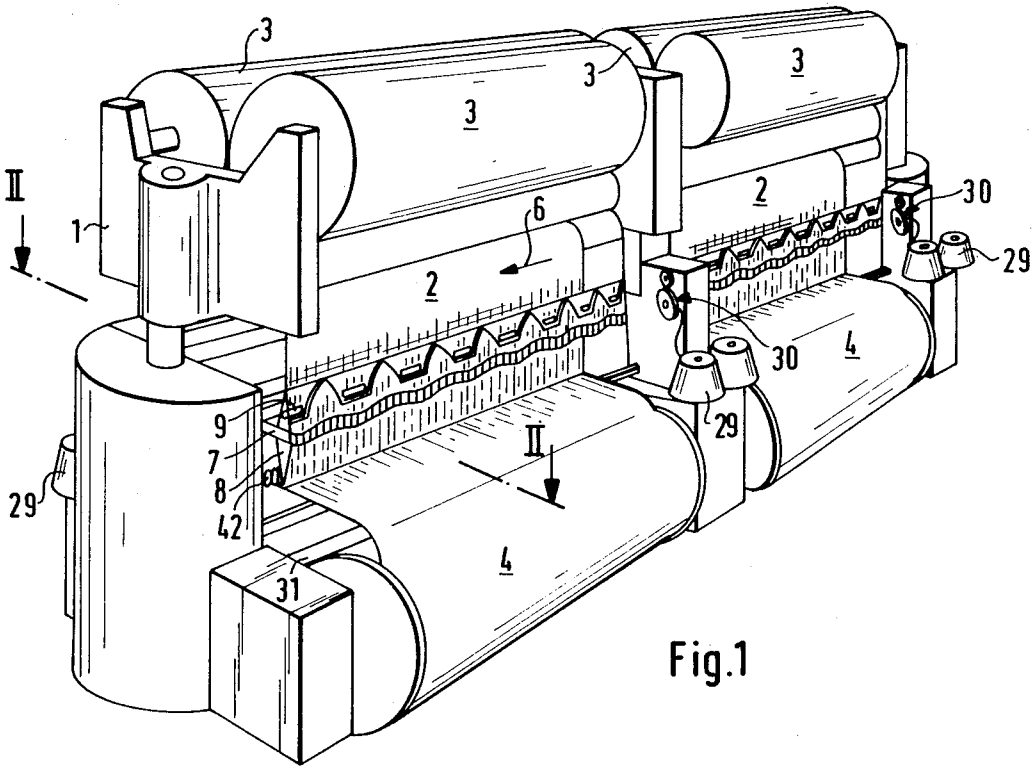
FIG. 1 is a perspective view of a multi-unit flat weaving loom constructed in back-to-back arrangement, omitting any elements not necessary for an understanding of the present invention.

The weaving loom shown in FIG. 1 is constructed in double-flat weaving back-to-back manner. A frame 1, shown only schematically, supports four weaving units, for simultaneous manufacture of four fabric webs 2. Each one of the webs 2 is rolled on a take-up roller 3, receiving the manufactured fabric. Warp beams 4 are provided to permit pull-off of warp threads or yarn 5 (see FIG. 3). The warp threads are moved laterally by heddles 7, progressively, transversely to the direction of the warp threads derived from the warp beam 4, to form a traveling shed 8, which travels in the direction of the arrow 6, in undulating form (see FIG. 4), from right to left, or left to right, respectively, with respect to FIG. 1. Each one of the sheds has a shuttle 9 passing therethrough. The construction of such a shuttle is disclosed and shown in U.S. Pat. No. 3,626,990, for example.

Figure 2:
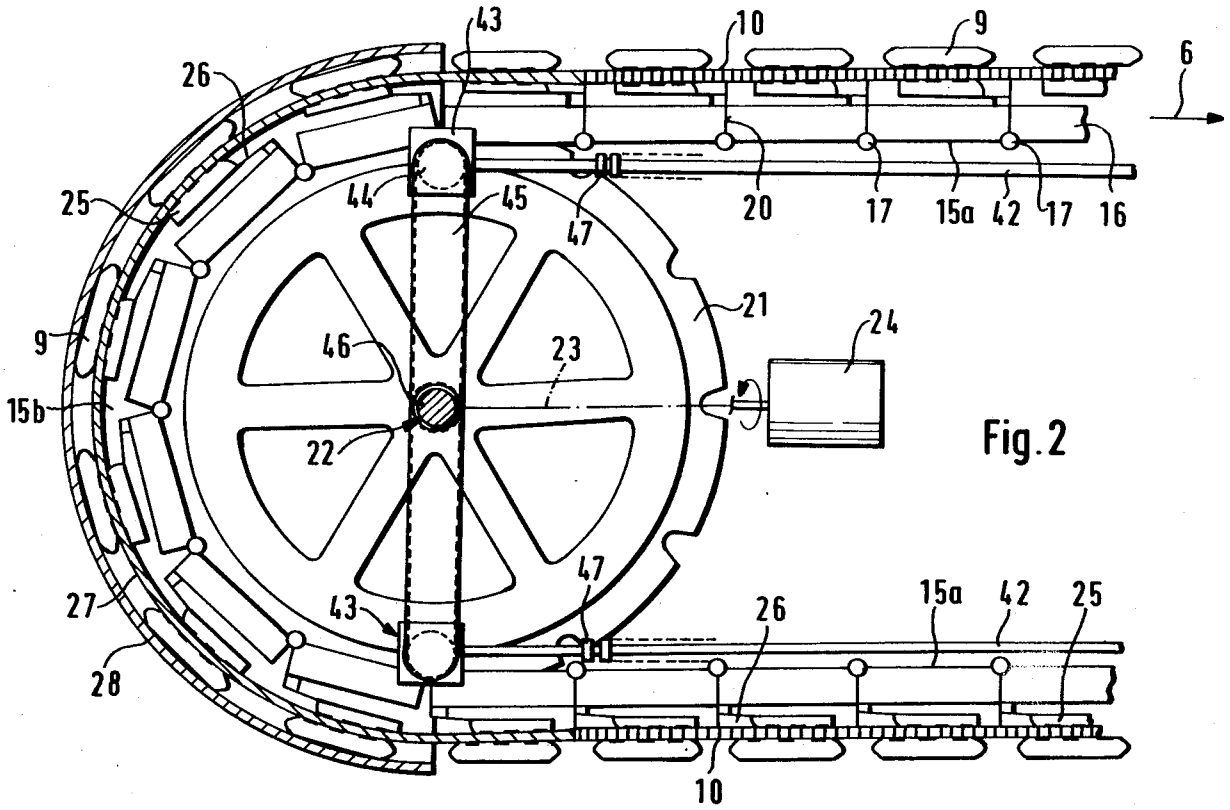
FIG. 2 is a fragmentary cross section in a horizontal plane looking in the direction of the arrows II—II of FIG. 1, to illustrate the weft thread insertion drive, and placement of a control cam shaft for synchronization.

The shuttles 9—see also FIG. 2—run staggered, one behind the other, in predetermined spacing on a guide track which is formed on one side by a reed or slay 10, through which weft thread engagement strips extend—not further shown—for additionally guiding the shuttles 9. U.S. Pat. No. 3,049,135 illustrates a suitable construction, to which reference is made for structural details.

The guide path or guide tracks along which the shuttles 9 run is formed of two straight portions 15*a* (FIG. 2) and two adjacent semi-circular curved return portions 15b. The shuttles 9 are moved in unison and in the same direction by shuttle drive elements 16. The drive elements are either directly coupled to joints 17 which couple the shuttles 9 together (FIG. 2) or are coupled, adjacent each other, to an endless chain. Upon passing the straight portions 15*a* of the guide track, the shuttles 9 can engage with their adjacent end surfaces 20 on each other, or they may be located spaced from each other.

The drive segments 16 are joined together in a common endless chain. They are guided over a sprocket wheel 21, operating over a vertical shaft, rotatably supported in the machine frame 1 in any suitable manner. The two sprockets 21, one on either terminal end of the machine, are splined to vertical main shafts 22 which are suitable supported in the machine frame. At least one of the main shafts 22 is coupled to an electric gear motor 24, shown only schematically, by a drive connection or gearing 23, so that the respective sprocket wheels 21 drive the drive segments 16 in a uniform direction, as shown by arrow 6 in FIGS. 1 and 2.

An elongated, forward upwardly bent drive portion 25 is located on each one of the segments 16, on the side facing the guide surface for the shuttles 9. A projecting leaf spring 26, projecting from the sides of the associated drive segment 16 retains the drive portion 25, for limited movement with respect thereto. The leaf spring 26 presses the drive portion 25 with elastic bias towards the reed or slay or, in the circular return portion 15b, against a bowed guide leaf 27, respectively (see FIG. 2). The shuttles 9 are located opposite the respective drive portions 25, and coupled with the drive portions 25 by a permanent magnetic coupling, as described, for example, in U.S. Pat. No. 3,618,640, and in German Patent No. 1,785,147. A semi-circular guide rail 28 provides for radial guidance of the shuttle 9 when the shuttles pass through the return portions 15*b* of their guide path.

The shuttles 9 receive weft threads before entry into the shed 8 from supply packages 29—see FIG. 1—which are shown only schematically. Storage elements for the weft threads may be located between the thread packages 29, from which the actual weft thread is drawn off, to supply the shuttles with the requisite weft thread by a weft thread supply device, only shown schematically at 30, for example by supplying precisely measured lengths of weft thread material.

Four weft thread supply arrangements 30 are provided on the machine of FIG. 1, which has two back-to-back units for simultaneous production of four woven webs 2. Two each of the weft thread supply units 30 are located on any one side of the machine.

Figure 3:
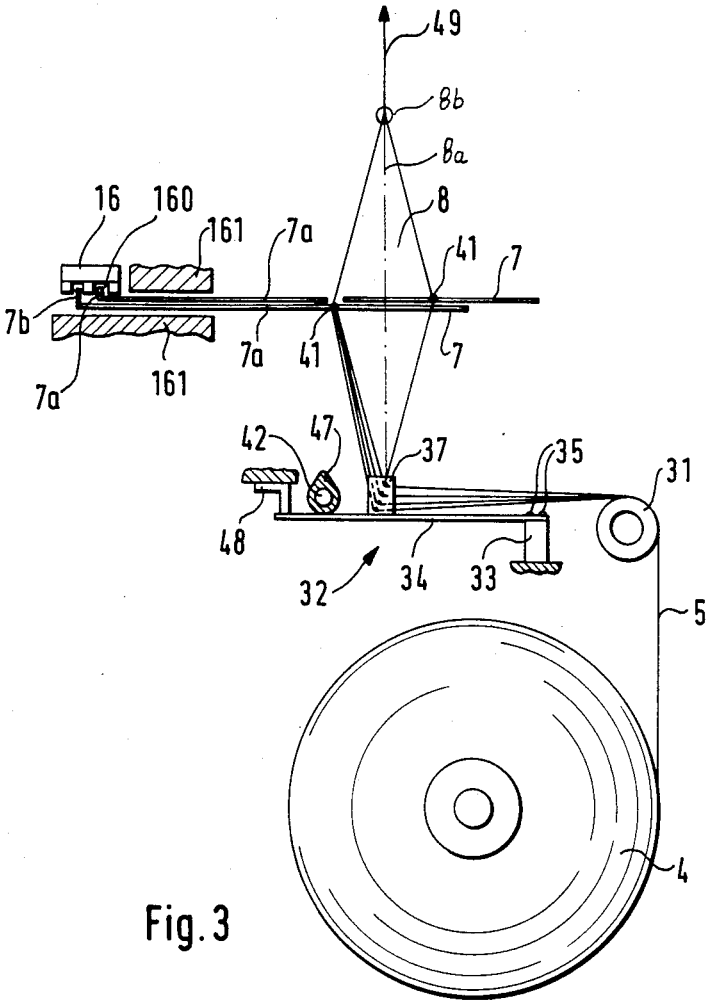
FIG. 3 is a schematic vertical sectional view, illustrating the path of the threads from the warp beam to take-up, and the equalization apparatus in accordance with the invention.

The respective drive segments 16 are guided on suitable guide tracks secured to the machine frame 1. At the lower sides of the drive segments 16, that is, on the sides facing the heddles 7, the drive segments 16 are formed—see FIG. 3—with control cam tracks 160, shown in FIG. 3 only schematically. Butts 7*b*, secured to the shafts or shanks 7*a* of the heddles 7, extend into the cam tracks. The cam tracks are so shaped that, upon longitudinal movement of the drive segments 16 in the direction of the arrow 6, the heddles 7, which are retained on a heddle support bed or the like shown only schematically at 161 in FIG. 3, are subjected to a reciprocating movement, necessary to form the shed. The shape and arrangement of the cam tracks 160 and control of the heddles 7 is well known, and may, for example, be constructed as shown in detail in U.S. Pat. No. 3,749,135 (to which German Patent No. 1,963,208 corresponds), the disclosure of which is incorporated by reference.

The group of warp threads 15, spooled off the warp beam 4, are guided,as best seen in FIGS. 1 and 3, first in an upward direction, approximately vertically, from which they are passed over a deflection roller 31, acting in the form of a back rail or rest. The deflection roller 31 has a smooth cylindrical surface and, as can be seen, is located on the forward or accessible side of the weaving loom, so that the respective warp threads 5 are accessible.

In accordance with the invention, an apparatus generally shown at 32 in FIG. 3 is provided to compensate for warp thread tension variations as the warp thread is deflected from a theoretical center plane 8*a* extending through the shed 8 by the heddles 7.

Figure 4:
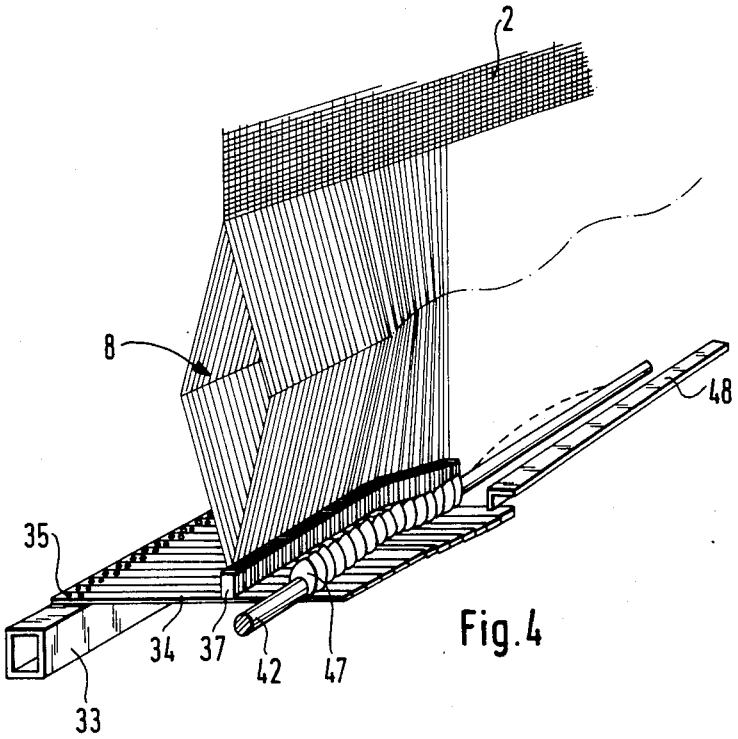
FIG. 4 is a fragmentary, partly broken away perspective view of the equalization apparatus.
Figure 5:
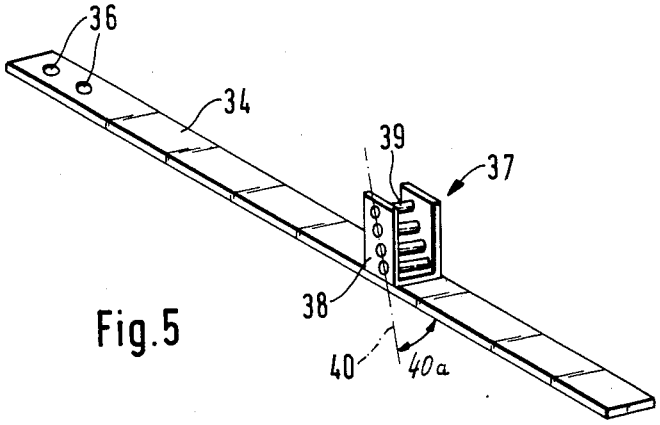
FIG. 5 illustrates a leaf spring support element including the thread deflection and guide element.

Referring now specifically to FIGS. 3 to 5: A carrier rail 33 which, preferably, is a hollow tubular element, for example of square or rectangular cross section, is secured to the machine frame in any suitable manner, extending transversely to the warp threads 5 and, in general, parallel to the deflection roller 31. The rail 31 carries a plurality of identical elongated leaf springs 34 (FIGS. 3, 5), which are attached at one end, for example by screws 35 (FIG. 3), to the rail 33, passing through suitable holes 36 in the leaf springs 34. The leaf springs 34 are positioned parallel to each other and spaced closely together in comb-like manner. In their normal position, they are located in a common horizontal plane and individually, that is, independently of each other, resiliently deflectable about their clamping position defined by the screws 35. As an example, for fabric of 1 meter width, about 100 of such leaf springs 34 are provided, each having a width of just slightly under 10 mm, to provide for mutual clearance.

Each one of the leaf springs 34 projecting from the rail 33 has a warp thread deflection element 34 attached thereto, rigidly connected to the respective leaf springs 34 (see FIG. 5). The deflection elements, as best seen in FIG. 4, are located in a common vertical plane, extending parallel to the shaft of the warp beam 4. Each deflection element 34 is a generally U-shaped sheet metal element 38, welded or riveted to the respective leaf spring 34, and having free upwardly extending legs which form a plurality of bearing elements for a plurality of warp thread guide elements, in the form of transversely extending rods 39. The rods 39 are cylindrical, formed with a polished surface and, if necessary, hardened or coated with a wear-resistant coating. The rods 39 extend parallel to each other and transversely to the direction of the warp threads. As best seen in FIGS. 3 and 5, they are offset with respect ot each other both in the direction of run-on of the warp threads as well as run-off, so that the axes of the rods 39, as seen in FIG. 5, are located on a line 40 which extends at an inclination with respect to a line perpendicular to the respective leaf spring 34.

The warp threads 5, spooled off the warp beam 4, and deflected by the deflection roller 31 into essentially horizontal directions (see FIG. 3), are again deflected by the deflection elements 37 by about 90° into approximately vertical direction so that the warp threads leave the rods in a tangential direction and generally in line with center line or plane 8*a*. They then pass through the eyes 41 of the heddles 7 where they are joined with the weft thread introduced in the shed plane into the shed to form the finished fabric.

A group of, for example, 10 warp threads are guided over each one of the rod elements 39 in the deflection element 37. If coarse fabric is to be made, a lesser number of warp threads can be guided thereover, and for quite coarse fabric, each one of the rod elements 39 may deflect only a single warp thread or yarn 5. The lateral legs of the essentially U-shaped elements 38 provide for lateral guidance of the warp threads 5 as they are deflected by the rods 39, so that the warp threads are prevented from coming loose or off the deflection elements 37.

Various modifications may be made in the deflection elements; for example, the rod elements 39 may be rotatably retained within the leg portions of the U-shaped elements 37; they may also be replaced, for example, by thread guide eyes, thread guide bails, levers, rollers, or other essentially functionally equivalent deflection structures.

In accordance with a feature of the invention, the leaf springs 34 are coupled with control apparatus which moves the deflection elements 37 in accordance with a commanded movement in vertical direction. Thus, the warp threads 35, passing from the deflection rod or rail 31 to the deflection elements 37, receive a controlled vertical movement as the deflection elements 37 move. The control arrangement is formed, in accordance with a feature of the invention, by a cam shaft 42 located above the leaf springs 34 and extending at right angles thereto—see FIGS. 3 and 4. The cam shaft 42 is retained in the machine frame 1 in suitable bearings, not shown.

Each one of the fabric webs 2 have a cam shaft 42 associated therewith, see FIGS. 1 and 2. The cam shafts located at one side of the machine are coaxial, and coupled together; the cam shafts at opposites sides of the machine are coupled via an angular drive or gearing 43 of predetermined gear ratio for synchronized movement with the shuttles and the shed forming elements 16 by a gearing coupling the cam shafts 42 to the main drive shaft 22. This gearing, as best seen in FIG. 2, is formed by a gear belt 45 coupled to a gear or sprocket 44 located at a rotation input shaft of the gearing 43. The gear belt 45 is coupled to a second gear or sprocket 46 secured to the main shaft 22 for synchronized movement therewith. The main shaft 22, as described, drives the drive segments 16 via the sprocket 21. The drive elements 17, by means of the control cams 160, control movement of the heddles 7 and hence the formation of the shed. Thus, the rotation of the cam shafts 42 is synchronized and coupled to the shed formation, that is, to the movement of the heddles 7.

Each one of the cam shafts 42 has a plurality of cams 47 formed thereon, for example as separate elements or machined. The spacing of the respective cams corresponds to the central spacing of the leaf springs 34, and each leaf spring 34 has its own cam associated therewith. FIGS. 3 and 4 show how the leaf springs 34 are engaged by the cams 47. The leaf springs 34, in the portion between the deflection elements 37 and the ends thereof remote from the clamping ends 35 form, essentially, springy extension tongues or tines. The leaf springs 34 are clamped to the rail 33 with an upward bias, so that the leaf springs 34, by their own inherent resiliency engage the cams 47 of the associated cam shaft, regardless of the rotary position of the cam shaft.

A stop rail 48 is located laterally adjacent the cam shaft 42, secured to the machine frame 1 in any suitable manner. The stop rail 48, for example, is formed as an angle rail, and so positioned that the free ends of the leaf springs 34 can engage thereagainst, and be supported thereby, and preventing deflection of the leaf springs 34 about their clamping point 31 in clockwise direction, with reference to FIG. 3. Thus, the position of the deflection elements 37, with the cam shaft 37 in the position shown in FIG. 3 is determined. The lands of the cams 47, as shown in FIG. 3, are out of engagement with the leaf springs 34. FIG. 4 illustrates the arrangement in perspective, in which the abutment rail 48 is broken away, so that the leaf springs 34 and the formation of the shed can be clearly visible.

The respective lands of the cams 47 are located on the cam shaft 42 to be spirally rotated, so that, upon rotation of the cam shaft 42, a continuous limited individual deflection of the springs 34 will occur, as the shed 8 opens and is formed. This results in an upward and downward movement of the warp thread deflection elements 7, which, thereby, compensate for changes in tension as the path length of the warp threads from the deflection elements 37 to a reference position 8*b*, for example a predetermined take-off or take-off roll position, changes.

The gear ratio of the gear 43 is so selected that the cam shaft 42 rotates exactly once when a shuttle passes through the shed for the specific shuttle, which may be termed a weaving system or feed. As shown, in the cams 47 may be formed as single-sided eccentrics. Cams 37 of different shape may be used, for example of double-sided eccentrics in which, then, the gear ratio should be so selected that the cam shaft 42 rotates only by a half revolution for each run of a shuttle through a feed or weaving system.

Let it be assumed that, for fabric of 1 meter width, each weaving system or unit length is 20 cm. The leaf springs 34 are just under 1 cm wide so that 20 leaf springs control the warp threads for one weaving system, that is, are associated with the warp threads of the shed through which a specific shuttle passes. Then for each run through a weaving system or unit, one revolution of the cam shaft 42 fitted with the cams 47 is necessary. The offset of adjacent cams 47 then will be 18°, in the direction of rotation, with respect to each other based on: 360°: 20=18° offset. The duration and the deflection distance with respect to time of the leaf springs 34 is determined by the shape of the cam surface of the cams 47. Maximum deflection of each leaf spring 34, in counterclockwise direction with respect to FIG. 3, occurs when the shed is closed, that is, when the weft thread is fixed in position. The deflection of the leaf springs travels, together with the formation of the shed, progressively, over the entire width of the fabric.

OPERATION

Let it be assumed that the weaving loom has been started and is in operation. The sprockets 21 will rotate, with respect to FIG. 2, in clockwise direction, driven by the motor 24. The drive segment 16 will move in the direction of the arrow 6 (FIG. 1). The control cams 160 of the drive segments 16 will so control the heddles 7 that, from the left towards the right, an undulating wave-shaped shed will be opened, traveling across the width of the fabric 2. The respective shuttles 6 introduce their width of the fabric 2. The respective shuttles 6 introduce their weft threads in the sheds 8, traveling in synchronism with the formation, that is opening and closing of the sheds.

In those regions where the shed 8 is open, the warp threads 5 will be in the position shown in FIG. 3, and the cam shaft 42 will have the corresponding position. The deflection elements 37, associated with the warp threads 5, are in the vertically uppermost position. The upper limit of movement of the deflection elements is limited by the stop 48. A tension force, schematically indicated by arrow 49, is applied upwardly which is absorbed by the attachment 35 to the rail 33 and the stop 48. The position of the deflection elements 37, the course or path of the warp threads 5 from the warp beam 4 to the take-up roller 1 and the formation of the shed will be as shown in FIG. 3. The warp threads 5 are under predetermined tension, required for fabric formation in weaving.

The shed 5 is closed by suitable control of the heddles 7 by the control cam 160 immediately behind the shuttle 5, which is moved by the respective drive segment 16. Simultaneously with the movement of the heddles to close the shed 8, the respective leaf springs 34 associated with the respective warp threads 5 are deflected in the direction of line 8*a*, since the cam shaft 42 has, in the meanwhile, rotated. Deflection of the leaf spring 34 is in counterclockwise direction about the clamping position 35 on the rail 33, with reference to FIG. 3. Consequently, the associated deflection elements 37 are drawn downwardly, in order to compensate the increase in thread path by withdrawal of the heddles from the position shown in FIG. 3 to a central position coincident with the central line 8*a*. The cams 47 are so shaped that the warp thread tension at a reference point, for example at point 8*b*, remains essentially constant or even. As soon as the shed 8 is closed, the weft thread is fixed in position by means, not further shown and well known in the industry, by suitable weft battling lamellae, illustrated for example in Czechoslovakian Patent No. 83,864.

Upon formation of the next subsequent shed 8, by pulling the respective warp threads 5 away from each other by the heddles 7, the cam 47 will continue to rotate and progressively release the springs 34, so that the associated deflection elements 37 may again move upwardly, with reference to FIG. 3. The extent of upward movement, and the temporal association of the upward movement with respect to the temporal association of the upward movement with respect to the lateral deflection of the warp threads 5, to form the shed, can be readily associated with each other, again to prevent any variation in yarn tension upon shed formation and, specifically, to prevent increase of thread or yarn tension in the warp threads as the shed opens. The carrier rail 33 and the stop rail 48 can be located on a machine frame either in fixed position or adjustably, in order to permit adjustment of the rails to the respective shed formation. The shed plane, shown schematically at 8*a* in FIG. 3, need not be vertical or entirely or precisely vertical; it may assume any angle, in space. The warp threads 5, supplied from the deflection elements 37, then must be located in a suitable plane, in such a manner that a deflection by the deflection elements causes a change in path length. Preferably, the deflection elements deflect the warp threads 5 by 90°, although the angle is not critical. Other deflection angles may also be used; it is only necessary that the limited movement of the deflection elements 37 compensates for changes in warp thread tension as the shed is formed, and travels transversely to the fabric or, in other words, in the shed plane shown at 8*a* in FIG. 3.

It may occur that malfunction arises in the formation of the shed or upon formation of the shed, or introduction of the weft thread, /and excessive tension is applied by the warp threads on the deflection element 37. The rail 48 prevents excessive deflection and overstressing of the leaf springs 34. The combination of stop rail 48 and attachment rail 33, thus, prevents overstressing of individual leaf springs 34.

Placing a cam shaft transversely to the leaf springs 34 and operating the cam shaft in synchronism with the control element or cam 160 which forms the shed is a simple and reliable arrangement; other control systems to control the operation of the leaf springs 34 or, rather, the movement of the deflection elements 37 can be used. For example, electrical or other operating elements can be associated with the deflection elements 37, sequentially controlled to move in a reciprocating movement, for example along the plane shown schematically at 8*a* in FIG. 3. The cam shaft arrangement is particularly preferred due to simplicity and reliability, and ease of placement transversely to the group of warp threads and extending essentially parallel to the warp beam. The individual cams 47 then individually control the individual leaf springs 34 by synchronized rotation of the single cam shaft 42.

The deflection elements 37 can be retained by resilient structures other than leaf springs, although the leaf springs are preferred. Preferably, they are engaged against the cam 47 by the bias inherent in the spring action of the leaf springs 34, so that precise scanning of the camming surface around the cam shaft 42 is always insured.

Preferably, each one of the deflection elements 37, as best seen in FIGS. 5, has a plurality of deflection rods 39, spaced from each other. This arrangement reliably prevents mutual interference and twisting or twirling together of warp threads. Further, the warp threads can be easily threaded, which is especially simple if the arrangement is as described, with the rod elements 39 being offset in the direction of the run-on as well as the run-off portions of the warp threads 5. Retaining elements 39 between two legs of a U-shaped structure is particularly simple and reliable, while additionally insuring lateral guidance of the warp threads 5. The staggering of the rod elements 39 contributes to spacing the respective warp threads 5, or groups of warp threads from each other, which additionally contributes to smooth operation and freedom from mutual interference of the threads with each other.

Various changes and modifications may be made within the scope of the inventive concept.

A suitable angel 40*a*, FIG. 5, for the staggering of the rod elements 39 with respect to the leaf spring 34 is about 75°. This angle is not critical.

I claim:

1. In a multi-system or multi-weaving unit weaving loom, a warp thread or yarn tension equalization system, said weaving loom having a warp beam (4) supplying a plurality of warp threads (5);

shed forming means (7, 16, 21) receiving the threads, said shed forming means respectively deflecting the threads from a theoretical central plane (8*a*), said central plane being symmetrical with respect to the shed formed by the shed forming means;

a goods take-up means (3); and thread guide means (31, 37) in the path of the warp threads from the warp beam to the shed forming means, deflecting the threads about a predetermined angle to the shed forming means for delivering of the threads at a predetermined tension; and wherein, in accordance with the invention, the thread guide means includes a plurality of independently movable deflection elements (37), each of which guides at least one warp thread (5);

means (34) for movably supporting each of the deflection elements (37) for movement essentially in the direction of the central plane (8*a*) to thereby maintain the direction of guidance of the warp threads during movement of said deflection elements; and movable control means (42, 47) coupled to the deflection elements (37) and moving the deflection elements in a direction along said central plane (8*a*) to compensate for shift of the path length of the warp threads with respect to a reference position (8*b*) in advance of the goods take-up means (3) between opening and closing of the shed (8), said control means being synchronized for movement of the deflection elements in synchronism with the shed forming means (7, 16, 21), said control means including force applying means (42, 47) acting on the individual deflection elements in moving the deflection elements in synchronism with movement of the shed forming means (7, 16, 21), thereby maintaining the thread tension of said warp threads essentially at a predetermined value.

2. The loom of claim 1, wherein said deflection element support means comprises a plurality of leaf springs (34) to which independent ones of said plurality of independently movable deflection elements (37) are secured.

3. The loom of claim 2 wherein each each deflection element (37) includes at least one rod element (19) positioned transverse to the running direction of the weft threads thereover and support means (38) holding said at least one rod element in position on the respective leaf spring to which the deflection element (37) is secured.

4. The loom of claim 2, further including a support rail (35) supporting said leaf springs (34) at one end, said leaf springs extending comb-like essentially perpendicularly from said support rail, and essentially parallel to the warp threads in the path of the warp threads from the warp beam (4) to the shed (8);

and wherein said deflection elements (37) are located on said leaf springs spaced from said fixed attachment to said rail.

5. The loom of claim 4, further including a stop rail (48) limiting deflection of the respective leaf springs in a direction of force exerted by the warp threads being pulled off the deflection elements.

6. The loom of claim 4, wherein the control means comprises a cam shaft (42) having cams (47) with cam lands formed thereon, said cam shaft (42) being driven in synchronism with the shed forming means (7, 16, 21);

and wherein the cam lands are engageable with individual ones of said leaf springs.

7. The loom of claim 6, wherein the support rail (35) and said leaf springs (34) are relatively positioned with respect to the cam shaft (42) to provide a bias force by said leaf springs against the cams (47) secured to the cam shaft (42) for positive engagement of the individual leaf springs with said cams (47).

8. The loom of claim 7 wherein each each deflection element (37) includes at least one rod element (19) positioned transverse to the running direction of the weft threads thereover.

9. The loom of claim 8 wherein said rod elements are positioned to direct and guide the weft threads in a direction along said central plane (8*a*).

10. The loom of claim 4, wherein each deflection element (37) includes a plurality of separate thread guide means (39), located in spaced position with respect to each other.

11. The loom of claim 10, further including a holding structure (38) retaining said thread guide means in position on individual ones of said leaf springs.

12. The loom of claim 11, wherein said thread guide means comprise a plurality of rod elements (39) positioned transverse to the running direction of the warp threads (5) thereover;

and support elements (38) holding said rod elements in position, and attached to terminal ends thereof and secured to the respective leaf springs.

13. The loom of claim 12, wherein said rod elements (39) extend parallel to each other and are staggered with respect to each other both in a direction of run-on of the respective warp threads and run-off of the respective warp threads.

14. The loom of claim 12, wherein said thread guide rods (39) are axially dimensioned to receive, each, a plurality or group of warp threads (5).

15. The loom of claim 1, further including stop means (48) limiting the movement of the deflection elements (37) in the direction in which the warp threads, being pulled off from the deflection elements attached to the respective support means, exert a pulling or tension force on the resilient support means.

16. The loom of claim 1, wherein the control means comprises a cam shaft (42) having cams (47) with cam lands formed thereon, said cam shaft (42) being driven in synchronism with the shed forming means (7, 16, 21); and wherein the deflection support element comprises resilient support means resiliently maintained in contacting engagement with the cams of said cam shaft.

17. The loom of claim 16 wherein said deflection element support means comprises a plurality of leaf springs (34) to which independent ones of said plurality of independently movable deflection elements (37) are secured, each of said leaf springs being associated with a cam (47) on said cam shaft.

18. The loom of claim 1, wherein each deflection element (37) includes a plurality of separate thread guide means (39), located in spaced position with respect to each other.

19. The loom of claim 18, wherein said thread guide means comprise a plurality of rod elements (19) positioned transverse to the running direction of the warp threads (5) thereover;

and support elements (38) holding said rod elements in position, and attached to terminal ends thereof.

20. The loom of claim 19, wherein said rod elements (39) extend parallel to each other and are staggered with respect to each other both in a direction of run-on of the respective warp threads and run-off of the respective warp threads.

* * * * *